United States Patent [19]

Sieberer

[11] 4,003,808

[45] Jan. 18, 1977

[54] METHOD AND APPARATUS FOR REGULATING AND CONTROLLING THE ANODE CURRENT AND FOR AVOIDING SHORT-CIRCUITS BETWEEN THE ELECTRODES OF AN ELECTROLYSIS CELL

[75] Inventor: Karl-Heinz Sieberer, Zirndorf near Nurnberg, Germany

[73] Assignee: Firm C. Conradty, Nurnberg, Germany

[22] Filed: Apr. 30, 1975

[21] Appl. No.: 573,367

[30] Foreign Application Priority Data

Nov. 14, 1974 Germany ..... 2454014

[52] U.S. Cl. ..... 204/99; 204/228

[51] Int. Cl.[2] ..... C25B 1/36; C25B 15/02

[58] Field of Search ..... 204/228, 225, 99

[56] References Cited

UNITED STATES PATENTS

| | | | |
|---|---|---|---|
| 3,574,073 | 4/1971 | Ralston, Jr. | 204/228 |
| 3,723,285 | 3/1973 | Daga et al. | 204/228 |
| 3,779,888 | 12/1973 | Bardahl et al. | 204/228 |
| 3,902,983 | 9/1975 | Warren et al. | 204/228 |

*Primary Examiner*—T. M. Tufariello

*Attorney, Agent, or Firm*—Andrus, Sceales, Starke & Sawall

[57] ABSTRACT

A method for regulating and controlling the anode current and for avoiding short-circuits between the adjustable anodes and the cathode of an electrolysis cell, wherein by means of an apparatus controlled by a field plate (magnetically controllable resistance), a magnetic diode or a magnetic transistor as sensor, the electrical resistance of which constitutes a measure for the current flowing to an anode or an anode group and, thus, having a nominal value of the resistance for a nominal value of the current, in case there is a deviation of the current from the nominal value the deviation of the electrical resistance of the sensor from the nominal value serves to reset the electrical resistance of the sensor and, thus, also the current of the anode or anode group to the nominal value by adjusting the anode or anode group.

8 Claims, 3 Drawing Figures

METHOD AND APPARATUS FOR REGULATING AND CONTROLLING THE ANODE CURRENT AND FOR AVOIDING SHORT-CIRCUITS BETWEEN THE ELECTRODES OF AN ELECTROLYSIS CELL

BACKGROUND OF THE INVENTION

The present invention relates to a method and an apparatus for regulating and controlling the current between amodes and cathodes in an electrolysis cell having adjustable, variable, anodes. The use with cells for the electrolysis of alkali metal chlorides with mercury cathodes will be particularly described below, although the apparatus and the process may also be used with many other kinds of electrolysis cells.

The graphite anodes which so far heretofore were usually employed in electrolysis of alkali metal chlorides are subjected during electrolysis operation to a constant burning off, with the space between the anodes and the cathode as a result becoming continually larger, and when the burn-off of the individual anodes is varying a varying anode current intensity in the individual anodes will be the result. It therefore is necessary in order to maintain economy of the electrolysis operation and to maintain a uniform current intensity in all anodes to subsequently adjust the anodes at certain time intervals.

On the other hand, coated, activated titanium anodes are being ever more frequently employed in the electrolysis of alkali metal chlorides since they for quite some time maintain their configuration for the entire duration of the electrolysis process. In order to maintain with respect to the economy of the electrolysis process the cell voltage as low as possible, the spacing between the anodes — for graphite anodes as well as also for titanium anodes — and the cathode is to be maintained as small as possible, however, and thus short-circuits between anodes and cathode and a non-uniform current load of the individual anodes, for example caused by deposition of amalgam butter and the change in height of the cathode resulting therefrom, can no longer be precluded. This may result in damage to the anodes and, moreover, to parts of the electrolysis cell. Furthermore, with coated titanium anodes overloads for prolonged periods of time that exceed the nominal load eventually lead to damage of the active layer and, thus, to a reduced service of life of the active layer.

Apparatuses for regulating the spacing or distance between the anodes and the cathode of an electrolysis cell and, thus, also for regulating the anode current are known, in which the magnetic field produced by the anode current is utilized for controlling the apparatus, with protective gas tube contacts or solenoid-operated switches being used as sensors. Besides the magnetic field produced by the anode current, a further magnetic field must still additionally be artificially produced and the signal for controlling the apparatus is obtained from the sum or the difference of these two magnetic fields. The generation of the second, artificial, induced magnetic field that is required with these known apparatuses involves a considerable drawback, since for generation and adjustment thereof additional loads, coils and control elements are required. A further drawback is that the protective gas tube contacts and solenoid-operated switches constitute mechanically operating structural elements and are subjected to all disadvantages and interferences inherent to electrical structural elements having mechanically operating contacts.

DESCRIPTION OF THE INVENTION

It is therefore an object to be solved by the invention to provide a method and an apparatus therefor for controlling the current consumption of individual anodes or individual anode groups.

It is a further object to regulate the anode current on the basis of the signals obtained by the controlling of the current consumption of the individual anodes or individual anode groups, and to adjust the anodes or anode groups, respectively, in order to avoid short-circuits.

According to a further object of the invention a method and an apparatus, therefore, should be provided in order to overcome the drawbacks inherent to the known apparatuses of the above mentioned type and their methods of operating them.

These objects are particularly advantageously solved in that an apparatus for controlling the anode current and avoiding short circuits between the anodes and the cathode of an electrolysis cell is comprising for the control of the apparatus a field plate, a magnetic diode or a magnetic transistor, with the resistance change of the sensor being effected by the magnetic field of the current flowing to an anode or an anode group. Field plates are also called magnetically controllable resistances and when introduced into an external magnetic field they change their electrical resistance in a definite manner. Magnetic diodes and magnetic transistors also change their internal resistances depending upon the magnetic pervading them.

The method according to the invention is comprising that by means of an apparatus controlled by a field plate, a magnetic diode or magnetic transistor as sensor, the electrical resistance of which constitutes a measure for the current flowing to an anode or an anode group and, thus, also having a nominal value of the resistance for a nominal value of the current, the deviation of the electrical resistance of the sensor from the nominal value is in case there is a deviation of the current from the nominal value, used in order to readjust or reset the electrical resistance of the sensor to the nominal value and, thus, also the current of the anode or anode group to the nominal value by adjusting the anode or anode group.

Now the magnetic field $h_r$ of a straight conductor traversed by current at a spacing $r$ fits the following equation:

$$h_r = \frac{1}{2\pi} \cdot \frac{I}{r}$$

that is, when providing the sensor at a fixed spacing $r$ from the conductor traversed by current, the magnetic field pervading the sensor is proportional to the current I flowing through the respective conductor. Now with field plates, the increase in resistance of the field plate, starting at a specific magnetic field intensity, is proportional to the intensity of the magnetic field, and, consequently, the resistance increase of the field plate provided at a fixed spacing $r$ from the conductor is proportional to the current flowing through said conductor. The change of the resistance of the field plate thus constitutes a measure for the change of the current flowing through the conductor. In the same way, though in a more complicated manner, the electrical resistance in magnetic diodes and magnetic transistors is closely associated with the intensity of the magnetic field pervading the magnetic diodes or magnetic transistors.

DETAILED DESCRIPTION OF THE PREFERRED EMBODIMENT

Figure 1:
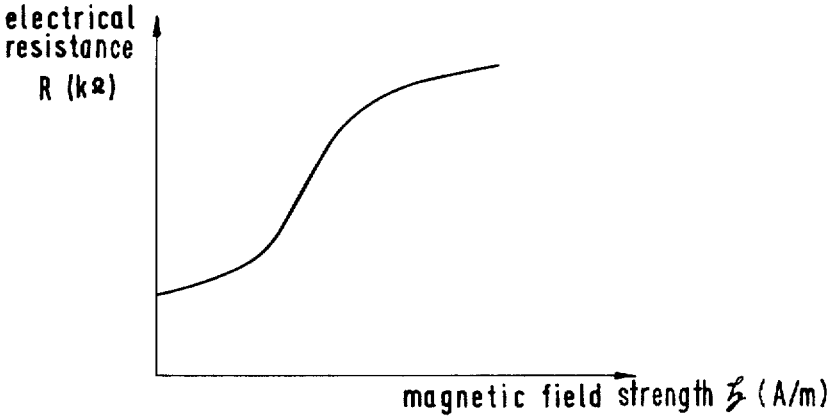
FIG. 1 is a diagram showing the dependence of the electrical resistance of a magnetic diode upon the magnetic field pervading it.

FIG. 1 shows the dependence of the electrical resistance of a magnetic diode upon the magnetic field pervading it. On account of its material properties, the resistance value of a magnetic diode is to a large extent temperature-dependent. This great dependence on temperature of magnetic diodes can be overcome by two magnetic diodes arranged electrically in series, which, however, must be arranged in such a manner that they are pervaded oppositely by the same magnetic field. This arrangement is called a magnetic double-diode. Also in case of the field plates and magnetic transistors, temperature-responsive structural parts may be provided which counteract a temperature-dependent resistance change of said sensors.

According to a general embodiment of the apparatus of the invention, the nominal current intensity of the anodes is linked up with a nominal value of the resistance of the sensors. Deviations of the resistance value of a sensor by more than a tolerated amount cause the generation of an electrical signal.

For example, in the process of the invention for controlling the anode current and for avoiding short-circuits between the adjustable anodes and the cathode of an electrolysis cell by means of an apparatus controlled by a field plate, a magnetic diode or a magnetic transistor, the electrical resistance of which constitutes a measure for the current flowing to an anode or anode group and, thus, has, for a nominal value of the current also a nominal value of the resistance, the deviation of the electrical resistance of the sensor from the nominal value in case that there is a deviation of the current from the nominal value, is utilized in order to adjust the electrical resistance of the sensor and, thus, also the current of the anode or anode group to the nominal value again by adjustment of the anode or anode group. Adjustment of the anode or anode group depending upon the degree of automation of the electrolysis system occurs manually or by means of servo-motors, preferably adjusting entire groups of anodes. Control of the servo-motors takes place through the apparatus of the invention for a time until the sensor has again attained its nominal value. In order to reduce the number of such adjustments, a deviation of the sensor value from the nominal value may also be tolerated within larger predetermined limits. The automatic adjustment of the respective anodes or the indication that an adjustment of the anodes is to be effected manually at any rate occurs only after the predetermined limit value has been exceeded.

In case that the anode current of each individual anode is to be controlled, a sensor is required for each anode, whereas only one sensor is required for governing anode groups, to wit at the location at which the total current of the group to be governed is flowing. In case that individual anodes are governed, the sensor usefully is provided on the anode current supply rod and in case that anode groups are governed the sensor is attached to the common copper band or to the copper strip. The field plates, magnetic diodes or magnetic transistors used as sensor do not at all have to be secured directly on the current conductor. They may also be secured at a slight spacing therefrom and, moreover, a screening against shielding outside fields may be provided.

Considering that an electrolysis system usually consists of several cells, with each cell having a plurality of anodes, it will not be necessary — in case this is intended for cost reasons — to provide a complete indication and control unit for each electrolysis cell in order to control the servo-motors of each electrolysis cell. It is possible to subsequently switch the sensors of the anodes and the servo-motors of each electrolysis cell to an indicating and control unit by means of electronic change-over switches which have a sufficiently high change-over frequency. A particular advantage involved herein, which results from the use of field plates, magnetic diodes or magnetic transistors as sensors, is that in these electronic structural parts only the determination of their electrical resistance is necessary. It is possible to make this resistance determination within a much shorter period of time than is the case with conventional means, in which a second magnetic field must be artificially developed. Moreover, extreme resistance changes of the sensors, as they are caused by a suddenly occurring strong short-circuit, may be detected by means of simple apparatuses which cause the cell cover to rise promptly even when the indication and control unit at this moment is switched to the sensors of another electrolysis cell. This may be the case in systems having a plurality of cells and being provided with an electronic change-over switch of high switching frequency it is despite of such a high switching frequency possible that the indication and control unit just at the moment of occurrence of a strong short-circuit is not switched to that cell in which such a short-circuit is occurring. Even under such adverse conditions it is then possible by means of simple apparatuses to cause the cover of the respective cell to rise promptly.

Figure 2:
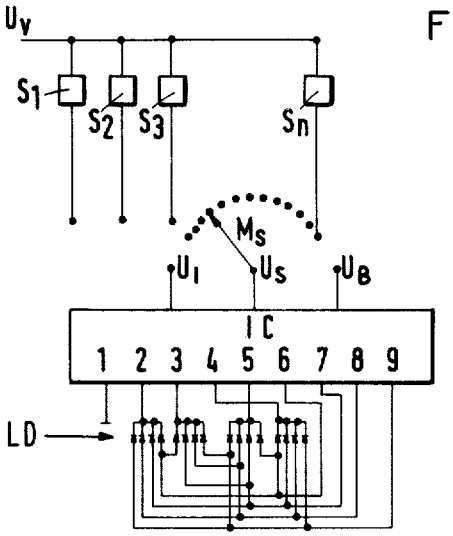
FIG. 2 is an embodiment of the apparatus according to the invention having a luminous diode indicator.

Although basically any method responsive to the resistance change of the sensor may be employed, the invention is to be explained in more detail below by way of an example, but it is not in any way to be restricted thereto. FIG. 2 shows an embodiment of the apparatus according to the invention having a luminous diode indicator. A conventional type of integrating circuit, designated IC in the figure controls the luminous diodes LD depending upon the initial voltage $U_S$ in such a manner that either the impression of an increasing light band is caused or that a light spot travels. The voltages $U_B$ and $U_V$ usefully constitute stabilized voltages for the integrating circuit (IC) and for the supply voltage of the sensors $S_1$ to $S_n$ provided on the first to the $n^{th}$ anode or anode group of an electrolysis cell. $M_S$ designates the preferably electronic selector switch, which always switches the $n^{th}$ anode or anode group of an electrolysis cell to the drawn IC. The IC's necessary for sensors $S_i$ to $S_{s-1}$ were not drawn for reasons of clarity. $U_S$ designates the control voltage for the integrating circuit resulting from the supply voltage $U_V$ depending upon the resistance of the sensor $S_n$, which depends upon the current load of the $n^{th}$ anode or anode group of the electrolysis cell. Usefully luminous diodes of the same type are used, but permissible and non-permissible regions may be marked by varying colours of the luminous diodes, for example green luminous diodes for normal load and red luminous diodes for overload. A transistor is switched parallel to or in place of the luminous diode indicating the highest current load, which transistor actuates the servo-motors through a relay or through thyristors in case that said luminous diode is controlled by the IC when the tolerated current load is exceeded, thus causing the corresponding cell over to rise abruptly or — when the adjusting apparatus is manually operated — generating an acoustical signal. Lowering of the cell cover may analogously also be controlled. The selection of the voltage $U_I$ permits to have the nominal value precisely in the center of the indicating range of the luminous diode scale. In case that the operator makes a desired change of the current load of the cell, the magnetic field on the sensors would change so that the new nominal value no longer is disposed in the center of the indication range of the luminous diode scale. However, the new nominal value can easily be brought to the center of the scale again by correspondingly changing the voltage $U_I$. At a desired change of the cell load, the change of the supply voltage $U_V$ has the same effect, with in this case $U_I$ not being changed.

In another embodiment, the sensors $S_i$ to $S_n$ shown in FIG. 2 can all be connected to the selector switch $M_S$, so that the current load of the anodes of a cell can be subsequently determined by means of an integrating circuit. This variation is of interest for electrolysis systems having only a few cells.

Figure 3:
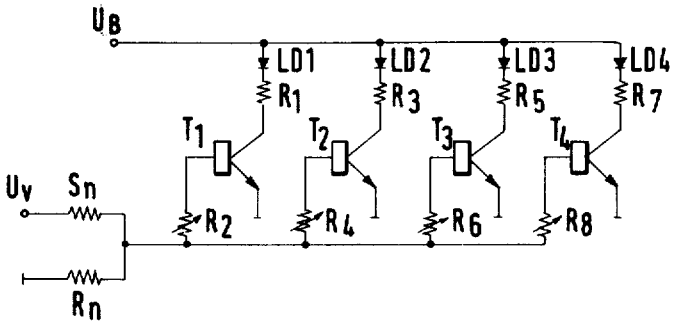
FIG. 3 is a partial view of the embodiment of FIG. 2, wherein the integral circuit of FIG. 2 has been replaced by a luminous diode-voltmeter.

In FIG. 3, the IC of FIG. 2 has been replaced by a luminous diode-voltmeter. The mode of operation corresponds to that one of the circuit of FIG. 2.

It is, to be understood, that the present invention is, by no means, limited to the description set forth, but also comprises any modifications made by the skilled in the art. Thus, the field plates, magnetic diodes or magnetic transistors may of course also be utilized as sensors for electronic computers, which govern the operation of the electrolysis system as process computer. Moreover, the use of these sensors is not limited to electrolysis cells having adjustable anodes, but the current intensity in other cells may also be measured by means of these sensors. In this case, the regulation of the current intensity will have to occur by suitable measures. For example, the current load of the individual anodes may also be determined by means of these sensors in electrolysis cells operating according to the diaphragm process.

What I claim is:

1. Apparatus for regulating and controlling the anode current and for avoiding short circuits between the anode means and cathode of an electrolysis cell, said anode means being positionable with respect to the cathode to control the current in an anode means current path, said apparatus comprising:

sensing means located along the current path for the anode means and within the magnetic field produced by the current, said sensor comprising semiconductor means, the resistance of which is responsive to the strength of the magnetic field and thereby proportional to the magnitude of the anode current;

means coupled to said sensing means for ascertaining the deviation of the resistance of said sensing means from a preselected value corresponding to a desired anode current value; and indicator means for indicating a deviation of said sensing means resistance and said anode current from said preselected value.

2. The apparatus according to claim 1 wherein said anode means has positioning means controlling its position and said apparatus further includes means coupled to said ascertaining means and to said anode positioning means for energizing said positioning means to move said anode means to restore said anode current and said sensing means resistance to said preselected value.

3. Apparatus according to claim 1 wherein said semiconductor sensing means comprises at least one of a field plate, magnetic diode, and a magnetic transistor.

4. Apparatus according to claim 1 wherein said indicator means incorporates luminous diodes.

5. Apparatus according to claim 3, wherein the sensing means is a magnetic double-diode.

6. A method for regulating and controlling anode current and avoiding short-circuits between an adjustable anode means and the cathode of an electrolysis cell by means of a semiconductor means, the resistance of which is responsive to the magnetic field produced by the anode current, said method comprising the steps of:

exposing the semiconductor means to the resistance changing magnetic field of the anode current;

ascertaining any deviation of the resistance from a preselected value corresponding to a preselected anode current value; and adjusting the position of the anode or anode group in the event of any deviation to restore the anode current and resistance to preselected values.

7. The method according to claim 6 further defined as exposing semiconductor means comprised of at least one of a field plate, a magnetic diode, and a magnetic transistor to the magnetic field.

8. The method according to claim 7 further defined as exposing a magnetic double-diode to the magnetic field.

* * * * *